US008242423B2

(12) United States Patent
Geswender et al.

(10) Patent No.: US 8,242,423 B2
(45) Date of Patent: Aug. 14, 2012

(54) MISSILE NAVIGATION METHOD

(75) Inventors: Chris E. Geswender, Green Valley, AZ (US); Matthew W. Cribb, Tucson, AZ (US); Clyde R. Hanson, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 709 days.

(21) Appl. No.: 12/476,486

(22) Filed: Jun. 2, 2009

(65) Prior Publication Data

US 2012/0043410 A1 Feb. 23, 2012

(51) Int. Cl.
*F41G 7/00* (2006.01)
*F42B 15/01* (2006.01)
*F42B 15/00* (2006.01)

(52) U.S. Cl. ..... 244/3.2; 244/3.1; 244/3.15; 701/1; 701/3; 701/4; 701/11; 701/400; 701/408; 701/500; 701/501

(58) Field of Classification Search ..... 244/3.1–3.19, 244/3.2–3.3, 158.1, 164; 89/1.11; 701/1, 701/3, 200, 207, 220, 221, 4, 13, 11, 12, 701/400, 408, 468–491, 500–512; 342/73, 342/89, 94, 95; 702/85, 104, 105, 127, 141, 702/150–154, 182, 92, 142, 145, 189, 190, 702/191; 73/178 R, 181
See application file for complete search history.

(56) References Cited

U.S. PATENT DOCUMENTS 5,400,033 A * 3/1995 Hablani ..... 342/95
6,427,131 B1 * 7/2002 McCall et al. ..... 702/150
6,473,713 B1 * 10/2002 McCall et al. ..... 702/141
6,496,779 B1 * 12/2002 Hwang ..... 701/220
6,498,996 B1 * 12/2002 Vallot ..... 702/104
6,516,283 B2 * 2/2003 McCall et al. ..... 702/141
6,522,992 B1 * 2/2003 McCall et al. ..... 702/141
6,596,976 B2 * 7/2003 Lin et al. ..... 244/3.2
6,600,976 B1 * 7/2003 Goodzeit et al. ..... 701/13
6,651,027 B2 * 11/2003 McCall et al. ..... 702/141
6,671,648 B2 * 12/2003 McCall et al. ..... 702/141
6,697,758 B2 * 2/2004 Lin et al. ..... 702/141
6,702,234 B1 * 3/2004 Goodzeit ..... 244/164
6,725,173 B2 * 4/2004 An et al. ..... 702/141
6,882,964 B2 * 4/2005 Bayard et al. ..... 702/191
6,955,082 B2 * 10/2005 Adebjork et al. ..... 73/181
7,212,944 B1 * 5/2007 Kohler et ..... 702/145
7,328,104 B2 * 2/2008 Overstreet et al. ..... 701/220
7,341,221 B1 * 3/2008 Wilson ..... 244/3.21
7,421,343 B2 * 9/2008 Hawkinson ..... 701/220
7,587,277 B1 * 9/2009 Wells ..... 701/220
7,761,233 B2 * 7/2010 Schott et al. ..... 701/221
(Continued)

*Primary Examiner* — Bernarr Gregory
(74) *Attorney, Agent, or Firm* — Renner, Otto, Boisselle & Sklar, LLP

(57) ABSTRACT

A missile has a pair of systems to provide acceleration information during flight. The primary system is a microelectromechanical systems (MEMS) inertial measurement unit (IMU) that provides accurate rate sensor output, such as providing pitch and yaw rates, at low cost, over a wide range of conditions. However MEMS IMUs are susceptible to temporary incorrect responses when subjected to shocks, such as acoustic-range shocks, for instance in the range of 10-20 kHz. The missile includes a secondary system to temporarily provide acceleration data during the periods following shocks, when the MEMS IMU does not provide valid (reliable or usable) rate sensor output, for use in estimating pseudo pitch and yaw rates. The secondary system may be an accelerometer that does not provide navigation-quality acceleration data, but does provide a sufficiently accurate response in order to maintain stable flight during the post-shock period.

16 Claims, 4 Drawing Sheets

U.S. PATENT DOCUMENTS * cited by examiner

| | | | | |
|---|---|---|---|---|
| 7,979,231 | B2 * | 7/2011 | Eckert | 702/104 |
| 8,005,635 | B2 * | 8/2011 | Lin | 702/92 |
| 8,010,308 | B1 * | 8/2011 | Churchill | 702/104 |

$\delta_p$ = pitch control angle
$\delta_y$ = yaw control angle p = roll rate
q = pitch rate
r = yaw rate α = pitch angle of attack
β= yaw angle of attack $X_B$ = body longitudinal axis
$Y_B$ = body "yaw" axis
$Z_B$ = body "pitch" axis $U = X_B$ velocity
$V = Y_B$ "yaw" velocity
$W = Z_B$ "pitch" velocity
$V_M = SQRT (U^2 + V^2 + W^2)$

MISSILE NAVIGATION METHOD

GOVERNMENT RIGHTS

This invention was made with United States Government support under Contract number DAAE30-98-C-1079 awarded by the U.S. Army. The United States Government has certain rights in this invention.

BACKGROUND OF THE INVENTION

1. Technical Field of the Invention

The invention is in the field of missile navigation.

2. Description of the Related Art

It will be appreciated that improvements in the field of missile navigation would be desirable.

SUMMARY OF THE INVENTION

According to an aspect of the invention, a missile navigation system utilizes a microelectromechanical systems (MEMS) inertial measurement unit (IMU) as a primary rate sensor, and also has a secondary data source, such as an accelerometer, for use when no valid data from the MEMS IMU is available, such as when the MEMS IMU has been subjected to a recent shock, for example an acoustic shock.

According to another aspect of the invention, a method of navigating a missile includes the steps of: using a microelectromechanical systems (MEMS) inertial measurement unit (IMU) as a primary data source, to provide angular rate data to a navigation system of the missile except temporarily during periods following shock events to the missile; using at least a secondary data source to provide pseudo rate data to the navigation system during the periods following the shock events; and providing either the angular rate data and the pseudo rate data to an autopilot of the navigation system that directs a control section of the missile, to alter a course of the missile.

According to yet another aspect of the invention, a missile navigation system includes: a microelectromechanical systems (MEMS) inertial measurement unit (IMU); a secondary data source; IMU validity logic; a rate estimator; and an autopilot. The secondary data source is operatively coupled to the rate estimator to provide data to the rate estimator to allow the rate estimator to produce pseudo angle rate changes in yaw and pitch directions. The MEMS IMU and the rate estimator are coupled to the validity logic, which is in turn operatively coupled to the autopilot. The validity logic determines validity of data from the MEMS and IMU, and supplies to the autopilot either angle rate change data from the MEMS IMU or the pseudo angle rate changes produced by the rate estimator.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

The annexed drawings, which are not necessarily to scale, illustrate aspects of the invention.

DETAILED DESCRIPTION

A missile has a pair of systems to provide acceleration information during flight. The primary system is a microelectromechanical systems (MEMS) inertial measurement unit (IMU) that provides accurate rate sensor output, such as providing pitch and yaw rates, at low cost, over a wide range of conditions. However MEMS IMUs are susceptible to temporary incorrect responses when subjected to shocks, such as acoustic-range shocks, for instance in the range of 10-20 kHz. The missile includes a secondary system to temporarily provide acceleration data during the periods following shocks, when the MEMS IMU does not provide valid (reliable or usable) rate sensor output, for use in estimating pseudo pitch and yaw rates. The secondary system may be an accelerometer, such as a two-axis accelerometer, that does not provide navigation-quality acceleration data, but does provide a sufficiently accurate response in order to maintain stable flight during the post-shock period. Together the MEMS IMU and the secondary system provide robust low-cost parts of a navigation system to provide stable flight of a missile or other aircraft.

Figure 1:
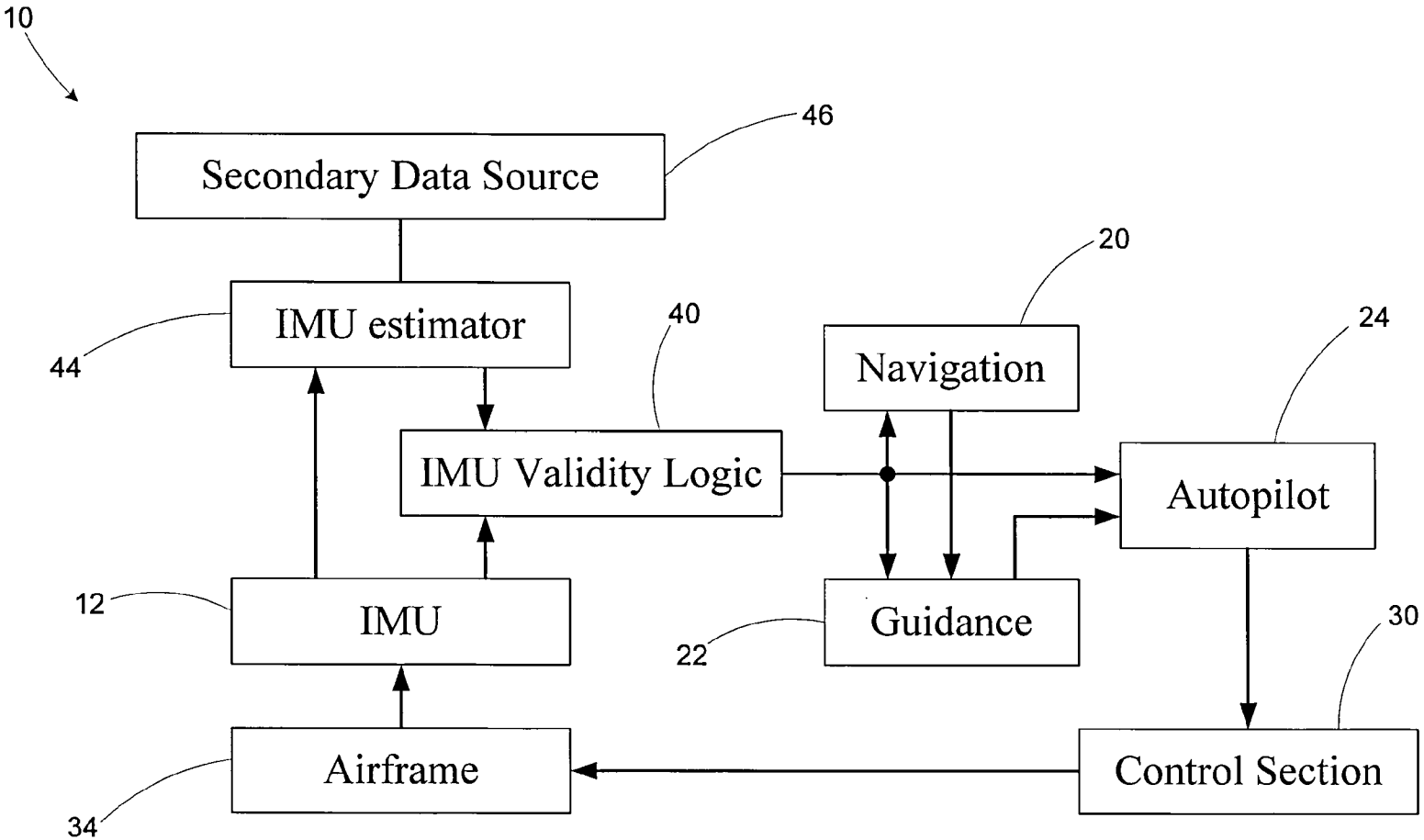
FIG. 1 is a block diagram of a control system in accordance with an embodiment of the present invention.

FIG. 1 shows a schematic diagram of an aerodynamic control system 10 for an aircraft such as a missile. A MEMS IMU 12 is used as the primary data source for providing angular rate data for the system 10, providing for example pitch and yaw rates for the missile or other aircraft. In normal operation the angular rates determined by the MEMS IMU 12 are provided to a navigation system 20, a guidance system 22, and an autopilot 24. The navigation system 20 provides and estimate of the weapon position and attitudes. The guidance system 22 provides the commands to deliver the weapon to the target The autopilot 24 takes information from MEMS IMU 12 (such as rate of change of angles such as pitch angle and yaw angle) and from the navigation/guidance systems 20/22, to provide appropriate signals to a control section 30 that controls actuatable portions of the missile to positively control the direction of flight of the missile. Such actuatable portions may include, for example, actuatable controls surfaces such as fins or canards. It will be appreciated that a wide variety of other actuatable portions may be used to vary the direction of the missile or other aircraft, including actuatable control surfaces and different types of vectored or directed thrust mechanisms. The control section 30 represents all of these possible mechanisms of altering or controlling the course of the missile. The control section 30 thus is coupled to an airframe 34 of the missile, to control the course of the airframe 34. Movement of the airframe 34 produces a response in the MEMS IMU 12, which completes the control loop for the missile.

As noted above, a problem may develop when the MEMS IMU 12 receives a shock. Such shocks may occur in any of a variety of circumstances, such as when (for example) blowing off a shroud from a seeker; deployment of a canard, wing, or fin, ejection from an airplane or other mother vehicle (such as being kicked off by a ejector shoe or being fired off by a launcher); or ignition of a rocket motor or other thruster.

Although the MEMS IMU 12 provides good output in a wide variety of circumstances, and has the advantageous ability to withstand forces associated with missile launch, it may be temporarily affected by shocks. The MEMS IMU 12 may be adversely affected in particular by shocks in the acoustic range, for example in the range of 10-20 kHz. The MEMS IMU 12 may become essentially disabled for a short period following receiving a shock, with the MEMS IMU 12 unable to output data, such as angular rate changes, with enough accuracy to allow the control system 10 to operate properly. Therefore the control system 10 includes IMU validity logic 40 to examine the output from the MEMS IMU 12, and to use the output data only if the data meets a certain validity criterion. The control system 10 also includes an estimator 44 that is used to provide a temporary substitute for the missing data from the temporarily incapacitated MEMS IMU 12. The estimator 44 relies on data from a secondary data source 46, such as an accelerometer or magnetometer, to provide data to substitute for the angular rate data usually provided from the primary data source, the MEMS IMU 12. The substitute may involve generation of pseudo rate data from acceleration measurements or another sensor.

Figure 2:
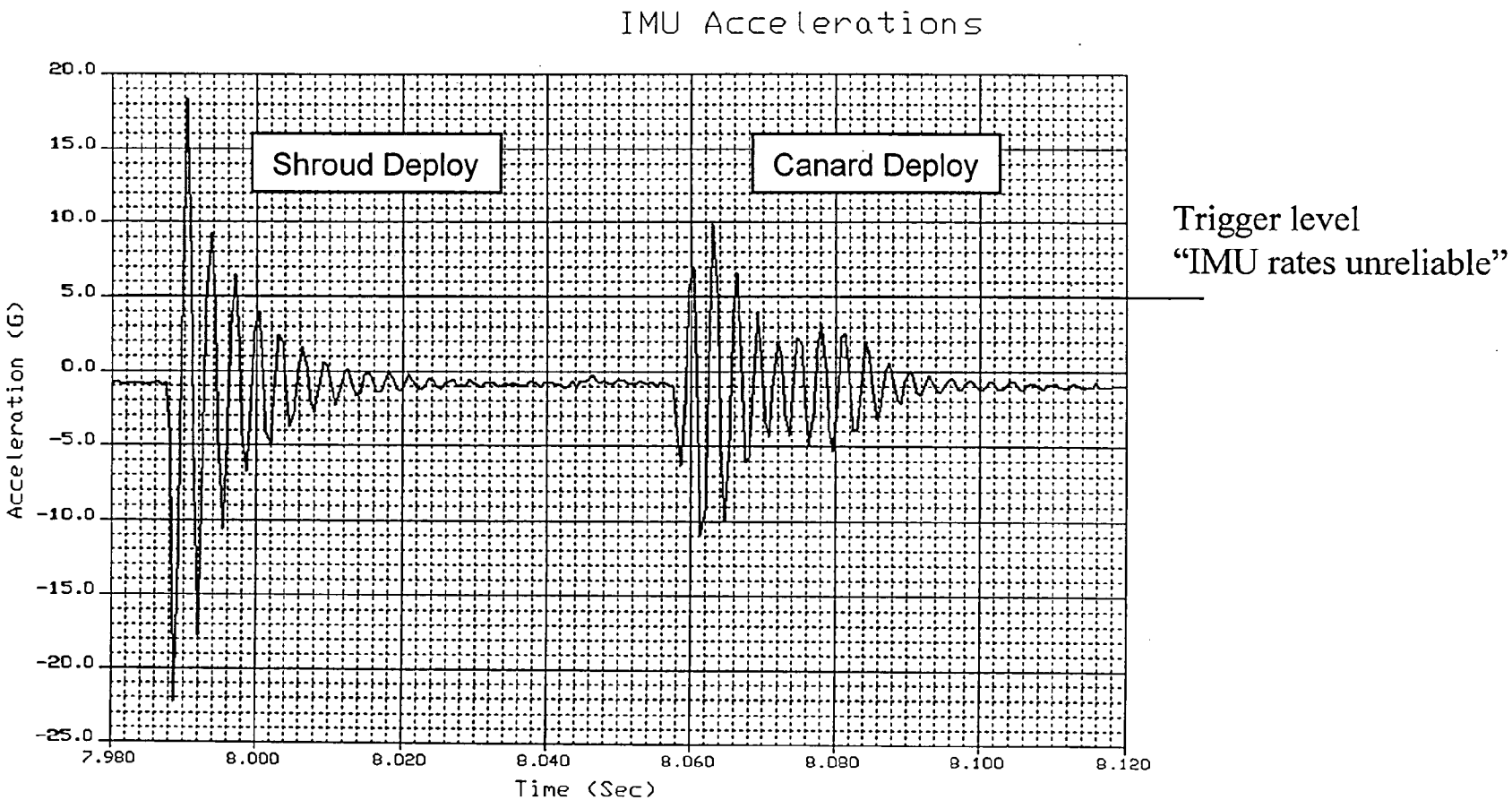
FIG. 2 is a plot showing acceleration measured by a MEMS IMU during and after shock events.

FIG. 2 shows accelerations recorded by a MEMS IMU 12 during and after a pair of shocks to the missile, a shock from a shroud deployment and a later shock from a canard deployment. Both of the shocks push the accelerations recorded by the MEMS IMU above a 5-g threshold that serves as a trigger threshold for determining unreliability of data from the MEMS IMU 12. It will be appreciated that the threshold illustrated is only one possible acceleration threshold that may be employed. Other acceleration levels may be used as a threshold for determining validity of MEMS IMU 12 output. Further, it will be appreciated that other types of thresholds, other than acceleration, may be utilized. For example, the thresholds could be timed from a commanded event, or a rate limit change that is outside reasonable reaction limits.

The testing of the validity of the output from the MEMS IMU 12 occurs in the IMU validity logic 40 (FIG. 1). The validity logic 40, as well as some other parts of the control system 10 (such as the estimator 44), may be embodied in a circuit card assembly (CCA), other type of circuit, or an algorithmic in the flight software. When the acceleration output from the MEMS IMU 12 exceeds the validity threshold, the validity logic 40 excludes use of the data from the MEMS IMU 12 for a period of time (either predetermined or testing for return to reasonable outputs). This period to recover has been observed to take from a few milliseconds to several seconds.

Figure 3:
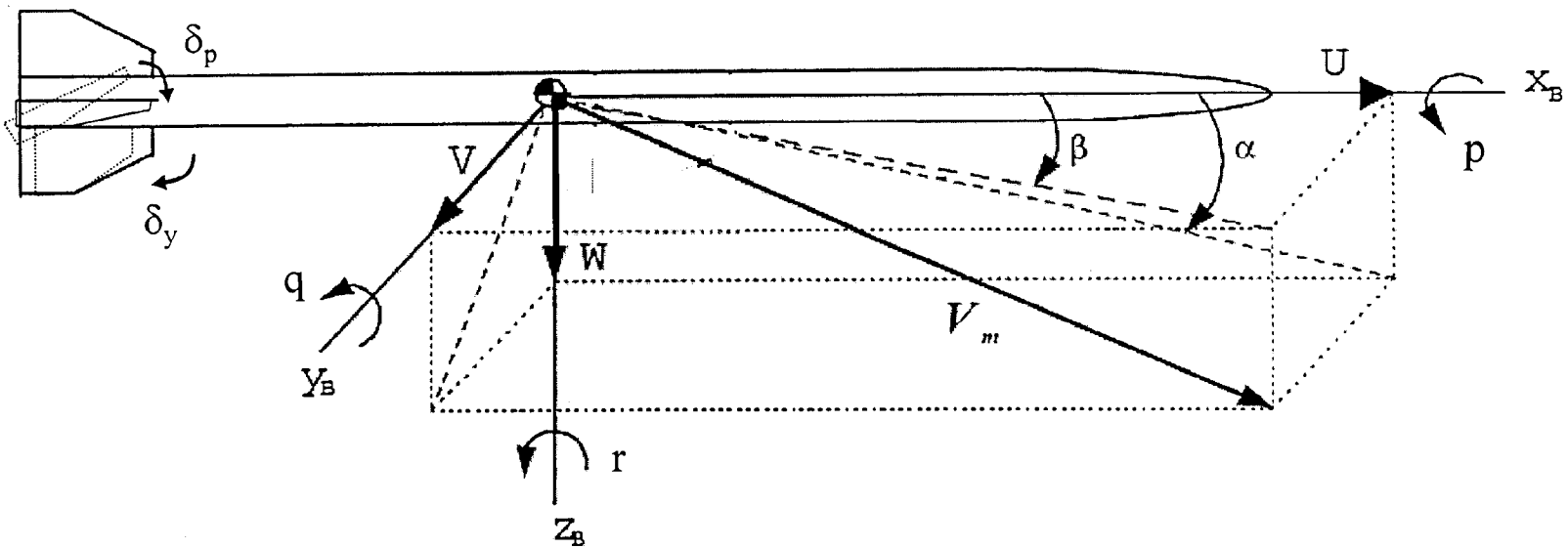
FIG. 3 is a diagram showing a coordinate system used in performing rate estimation according to the present invention.

FIG. 3 shows a coordinate system that is used in explaining below the estimated data produced by the estimator 44 (FIG. 1) as a temporary substitute for the unavailable data from MEMS IMU 12 (FIG. 1). In the diagram the following nomenclature is used:

$X_B$=body longitudinal axis
$Y_B$=body "yaw" axis
$Z_B$=body "pitch" axis
$U=X_B$ velocity
$V=Y_B$ "yaw" velocity
$W=Z_B$ "pitch" velocity
$V_M=SQRT(U^2+V^2+W^2)$
p=roll rate
q=pitch rate
r=yaw rate
α=pitch angle of attack
β=yaw angle of attack
$\delta_p$=pitch control angle
$\delta_y$=yaw control angle The yaw and pitch angles of attack are the angles between the vehicle (missile) attitude angle and the velocity vector angle. The pitch and yaw control angles are the angles of fins or other control surfaces of the missile.

The rigid body equations of motion provide a starting point for making an estimate of the relevant parameters:

$$A_y=QS/M*(Cn_\alpha*\beta+Cn_\delta*\delta_y) \quad (1)$$

$$A_z=QS/M*(Cn_\alpha*\alpha+Cn_\delta*\delta_p) \quad (2)$$

where:

$A_y$=yaw acceleration
$A_z$=pitch acceleration
Q=dynamic pressure
S=weapon cross section area
M=weapon mass
$Cn_\alpha$=lift coefficient derivative due to angle of attack
$Cn_\delta$=lift coefficient derivative due to command angles The rigid body equations of motion may be reordered in terms of the pitch and yaw angles of attack as follows:

$$\alpha=(MA_z/QS-Cn_\delta*\delta_p)/Cn_\alpha \quad (3)$$

$$\beta=(MA_y/QS-Cn_\delta*\delta_y)/Cn_\alpha \quad (4)$$

In these equations (3) and (4) $A_y$ and $A_z$ are known from the accelerometer output, $\delta_y$ and $\delta_p$ are known from prior settings of the control surfaces, and from feedback from those control surfaces, and Q, S, D, M, $Cn_\alpha$, and $Cn_\delta$ are all known properties of the missile.

At this point the values for α and β are filtered, and the filter generates the derivative terms, so the estimated α and β rate states are extracted from the filter. For short periods of time the rate of change of α may be taken as approximately equal to q, the pitch rate. Similarly, the rate of change of β may be taken as approximately equal to r, the yaw rate. Over long periods of time, longer than the time periods involved here, the wind axis will rotate to relieve the angle of attack and the equivalence approximation degrades. Thus the pitch rate and the yaw rate may be estimated from accelerometer output.

Figure 4:
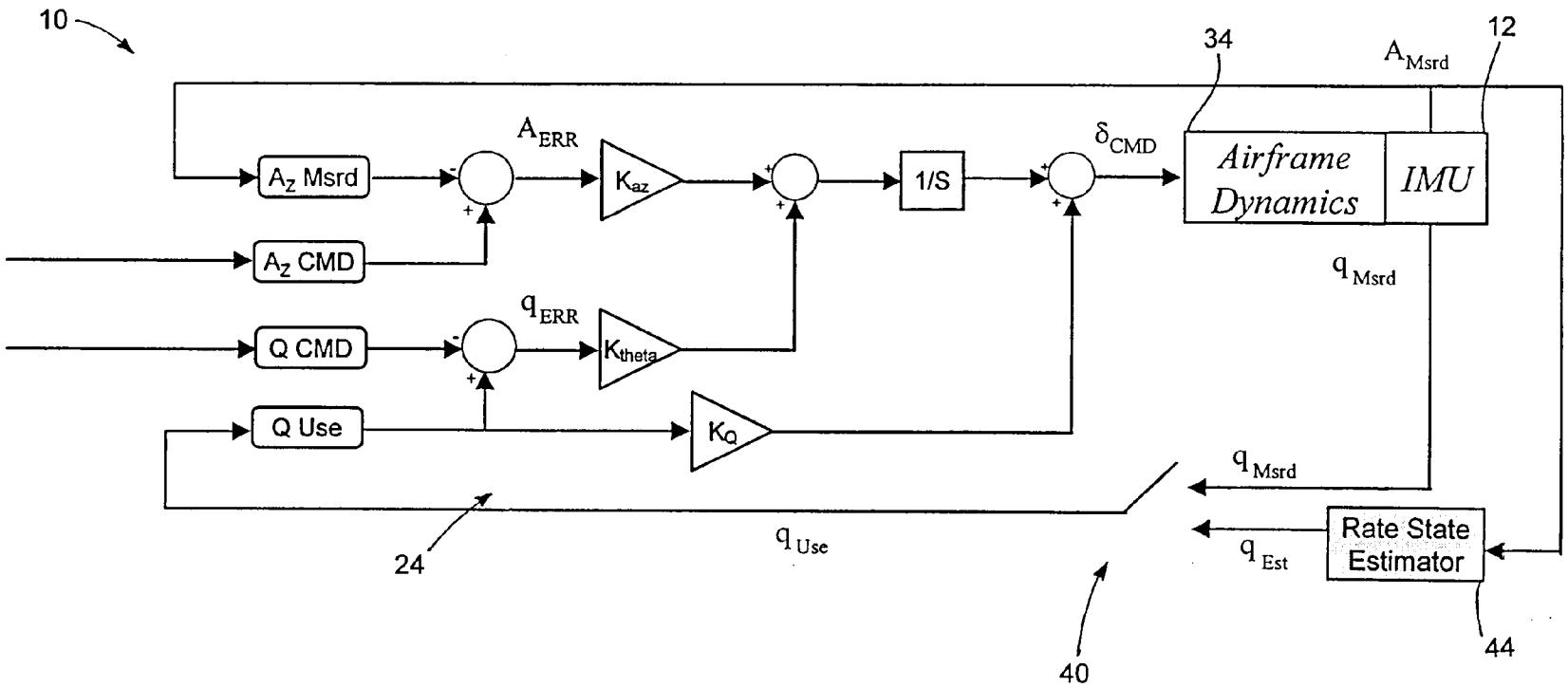
FIG. 4 is a function block diagram of part of an embodiment of the control system of FIG. 1.

It will be appreciated that some of the blocks shown in FIG. 1 may be combined in a single component. FIG. 4 shows an example of such a combination, with a pitch rate estimator 60 for the pitch rate q, part of the estimator 44 (FIG. 1), integrated with other components of the control system 10. The navigation system 20 shown in FIG. 4 outputs a command $A_z$ ($A_{zCMD}$) and a command q ($q_{CMD}$). The $A_{zCMD}$ value from the navigation system 20 is compared with a measured pitch acceleration $A_z$ that is taken from the MEMS IMU 12 or another IMU. Accelerometers have been shown to be more robust to shock than rate sensors, so there is no general need for a back-up data source to provide acceleration data. However it will be appreciated that the same technique as described above can be used by simultaneous solution for α and β in the force and moment equations.

The $q_{CMD}$ value produced by the navigation system 20 is also compared to a value representing the current aircraft operation. That q value, the $q_{USE}$ used by the autopilot 24, is either a measured value $q_{MEAS}$ received from the MEMS IMU 12, or an estimated value $q_{EST}$ provided by the estimator 44, for example along the lines described above. The decision whether to use $q_{MEAS}$ or $q_{EST}$ is performed by the validity logic 40, which acts as a switch in providing for the use of either $q_{MEAS}$ or $q_{EST}$.

The $A_z$ comparison and the q comparison produces a pitch acceleration error $A_{ERR}$ and a pitch rate error $q_{ERR}$ that are combined by the autopilot 24. The pitch acceleration error $A_{ERR}$ and the pitch rate error $q_{ERR}$ are used to produce a command input $\delta_{CMD}$ to command changes in the pitch control angle $\delta_p$ (FIG. 3) that the pitch control surface or surfaces (such as fin(s)) is/are set at. Various gain factors K may be used in combining the inputs to autopilot 24 to make the command input $\delta_{CMD}$. The command input $\delta_{CMD}$ is sent to the actuators for fins, canard, or other devices for altering course of the missile. These items are represented in FIG. 4 as the airframe 34, which it will be appreciated contains the control section 30 (FIG. 1).

It will be appreciated that a similar process may be performed for control of yaw of the aircraft (missile). With control of the yaw and pitch of the craft the missile or other craft can be maintained in stable flight, even in the periods after a shock when reliable output from the MEMS IMU 12 is unavailable. Since the airframe of the missile or other aircraft may be unstable, and thus unable to maintain stable flight without control input, even for a short time. The use of the secondary data source 46 (FIG. 1) enables the control system 10 (FIG. 1) to maintain the missile or weapon in controlled stable flight even in the short periods of time in which the MEMS IMU 12 (FIG. 1) does not provide reliable output.

It will be appreciated that the secondary data source 46 is used only as a temporary source of data for the control system 10, providing data for navigation only during the after-shock periods when the MEMS IMU 12 is effectively out of commission. As such it will be appreciated that the secondary data source 46 may have lower precision, precision that may not be sufficient for navigating the missile other than for the short time frames (such as from tenths of seconds to 2-3 seconds) that is temporarily required. The MEMS IMU may be a navigation quality device, defined herein as a device having an accuracy on the order of 10 degrees per hour of error. The secondary data source may have a lesser order of accuracy, for example be a guidance quality device, defined herein as a device having an accuracy on the order of 100 degrees per hour, or an autopilot quality device, defined herein as a device having an accuracy on the order of 1000 degrees per hour. It will be appreciated that the lesser quality devices used for the secondary data source may have the advantage of having a lower cost and/or a lower weight than navigation quality devices (especially navigation quality devices capable of withstanding shocks to be experienced by the missile).

The system described above allows use of MEMS IM Us by overcoming the problems in MEMS IMU output during and after shocks (or certain types of shocks). MEMS IMUs have numerous advantages that make them desirable for use in missiles: they have a very small size and weight, they are gun hardenable and thus are able to survive large accelerations associated with a launch process, and they generally produce navigation quality data.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A method of navigating a missile, the method comprising:

using a microelectromechanical systems (MEMS) inertial measurement unit (IMU) as a primary data source, to provide angular rate data to a navigation system of the missile, wherein the using is temporarily suspended during periods following shock events to the missile;

using at least a secondary data source to provide pseudo rate data to the navigation system during the periods following the shock events; and providing either the angular rate data or the pseudo rate data to an autopilot of the navigation system that directs a control section of the missile, to alter a course of the missile.

2. The method of claim 1, wherein the secondary data source includes an accelerometer.

3. The method of claim 2, wherein the accelerometer is a two-axis accelerometer configured to measure accelerations in pitch and yaw directions.

4. The method of claim 2, wherein the MEMS IMU provides navigation quality accuracy; and wherein the accelerometer has an accuracy lower that is less than navigation quality accuracy.

5. The method of claim 1, wherein the secondary data source includes an magnetometer.

6. The method of claim 1, further comprising selecting use of either the angular rate data or the pseudo rate data by the autopilot using IMU validity logic, wherein the IMU validity logic bases its selection on data from the MEMS IMU.

7. The method of claim 6, wherein the selecting includes comparing acceleration measured by the MEMS IMU with a predetermined acceleration validity threshold.

8. The method of claim 1, wherein the missile includes a rate estimator operatively coupled to the secondary data source; and further comprising producing the pseudo rate data in the rate estimator using acceleration data from the secondary data source.

9. The method of claim 8, wherein the producing includes using rates of change of angle of attack as approximations of the angular rates of change.

10. A missile navigation system comprising:

a microelectromechanical systems (MEMS) inertial measurement unit (IMU);

a secondary data source;

IMU validity logic;

a rate estimator; and an autopilot;

wherein the secondary data source is operatively coupled to the rate estimator to provide data to the rate estimator to allow the rate estimator to produce pseudo angle rate changes in yaw and pitch directions;

wherein the MEMS IMU and the rate estimator are coupled to the validity logic, which is in turn operatively coupled to the autopilot; and wherein the validity logic determines validity of data from the MEMS and IMU, and supplies to the autopilot either angle rate change data from the MEMS IMU or the pseudo angle rate changes produced by the rate estimator.

11. The missile of claim 10, wherein the secondary data source includes an accelerometer.

12. The missile of claim 11, wherein the accelerometer is a two-axis accelerometer configured to measure accelerations in pitch and yaw directions.

13. The missile of claim 11, wherein the MEMS IMU provides navigation quality accuracy; and wherein the accelerometer has an accuracy lower that is less than navigation quality accuracy.

14. The missile of claim 10, wherein the secondary data source includes a magnetometer.

15. The missile of claim 10, wherein the rate estimator uses rates of change of angle of attack as approximations of the angular rates of change.

16. The missile of claim 10, wherein the IMU validity logic and the rate estimator are embodied as a circuit card assembly.

* * * * *